United States Patent [19]

Asaka et al.

[11] 4,033,124

[45] July 5, 1977

[54] ARRANGEMENT FOR DERIVING INTAKE NEGATIVE PRESSURE FROM AN INTERNAL-COMBUSTION ENGINE

[75] Inventors: Urataro Asaka; Shuichi Yamazaki, both of Kamifukuoka; Mitsugi Niitsu, Higashikurume; Sakuji Arai, Wako, all of Japan

[73] Assignee: Honda Giken Kogyo Kabushiki Kaisha, Tokyo, Japan

[22] Filed: Dec. 23, 1975

[21] Appl. No.: 643,938

[30] Foreign Priority Data

Dec. 27, 1974 Japan .....49-148904

[52] U.S. Cl. ..... 60/290

[51] Int. Cl.[2] ..... F02B 75/10

[58] Field of Search ..... 60/290; 123/112 A, 119 A, 123/119 D; 261/69 R

[56] References Cited

UNITED STATES PATENTS

| | | | |
|---|---|---|---|
| 2,962,366 | 11/1960 | Oosterdijk | 261/69 R |
| 3,906,723 | 9/1975 | Matumoto | 60/290 |

*Primary Examiner*—Douglas Hart

[57] ABSTRACT

An arrangement for deriving intake negative pressure from an internal-combustion engine, comprising a carburetor in the latter, with an intake for an air — fuel mixture, a throttle valve therein for regulating the mixture, and at least one longitudinal passage therein for guiding the mixture toward the engine; an intake passage leading from the carburetor to the engine; which latter also has an exhaust passage leading therefrom; wherein the throttle valve has a shaft substantially transversally disposed in one of the passages of the carburetor, the latter being fitted with a discharge opening in a side wall of the intake passage to derive negative passage from the carburetor for regulating and controlling the engine operation; the discharge opening being provided in the flow of the mixture, in an area that is directed downstream from the throttle-valve shaft; whereby to avoid accumulation and discharge of condensed fuel from the carburetor to the discharge opening. The arrangement can be associated with a control circuit for the engine, including pressure-responsive elements, as well as an air pump for delivering secondary air to the exhaust passage of the engine. According to an important feature of the invention, an insert member is interposed between the body of the carburetor and the intake passage, with a connecting tube being integrally formed in the insert member but projecting therefrom, which tube is in communication with the discharge opening.

4 Claims, 2 Drawing Figures

Figures 1, 2:
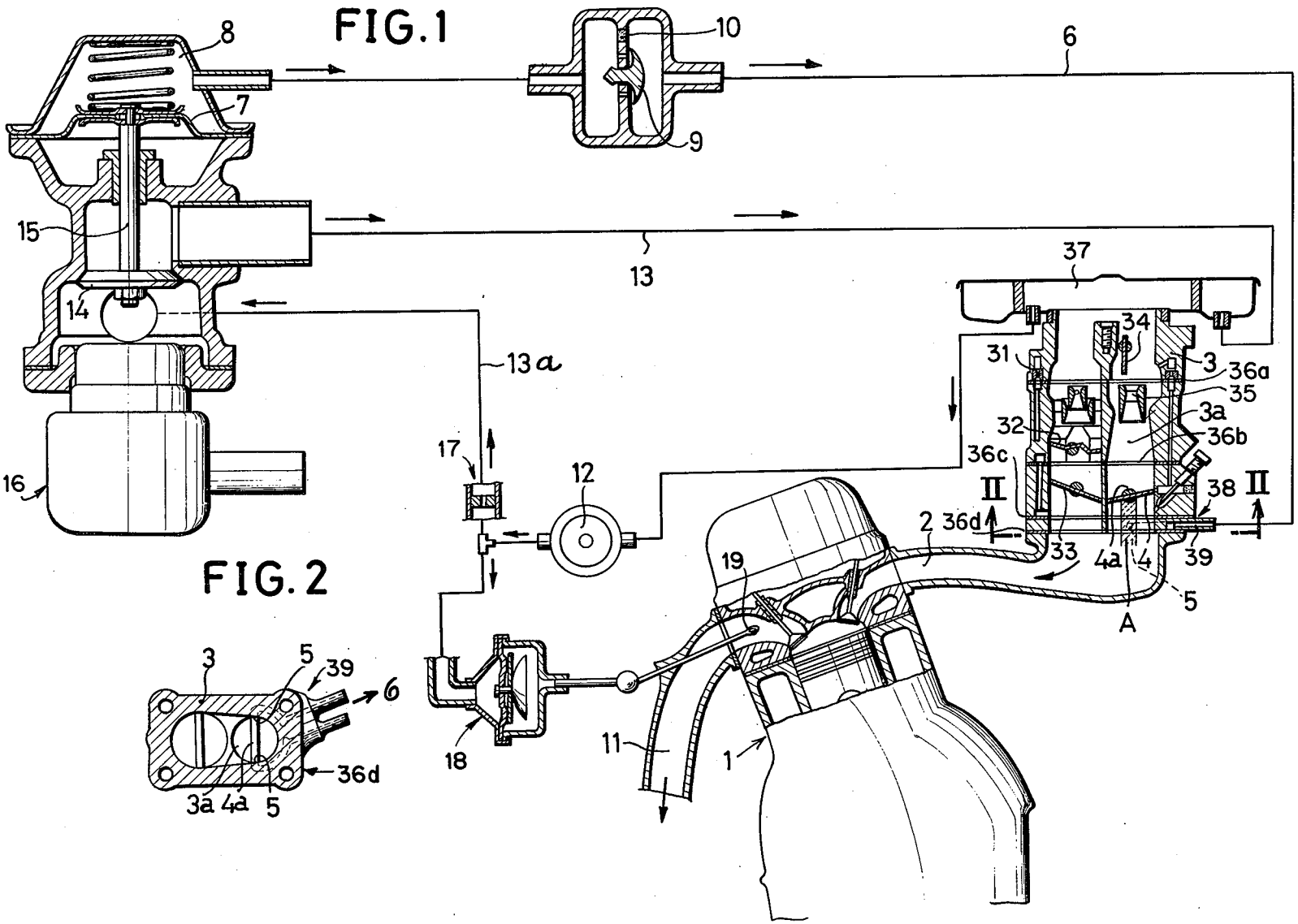

A
II
II
1
2
3
3a
4
4a
5
6
7
8
9
10
11
12
13
13a
14
15
16
17
18
19
31
32
33
34
35
36a
36b
36c
36d
37
38
39

ARRANGEMENT FOR DERIVING INTAKE NEGATIVE PRESSURE FROM AN INTERNAL-COMBUSTION ENGINE

The invention relates to an arrangement for an internal-combustion engine for a motorcar or the like wherein an opening is made in a particular area of the side wall of an intake passage of the usual carburetor in the engine, for discharging or deriving intake negative pressure generated therein, without the danger of condensed fuel entering that area.

With this kind of arrangement, generally fuel in the air-fuel mixture is liable to condense and adhere to the inside surface of the intake passage, and is then led to the discharge opening. Additionally, it should be noted that by such a pump action of a negative-pressure operated member, such as a diaphragm forming part of a suitable chamber, and connected to the opening through a discharge passage, the condensed fuel is drawn into the latter passage and is accumulated therein, and then the same is drawn back to be discharged therefrom. These are undesirable side effects.

Usually the discharge opening is in communication through the passage with the negative-pressure chamber that has its front surface constituted by the diaphragm, and is connected to a control member such as a valve. The negative-pressure operated diaphragm vibrates, to behave in pump fashion, according to variations in the negative pressure that is generated within the intake passage. Consequently it is likely that the condensed fuel flows in through the discharge opening, and also flows out therethrough.

If a sintered-metal orifice member is interposed in the discharge passage, for delaying operation, the inconvenience is likely to be caused that the fuel thus reaching the orifice member clogs the same. A check valve 9 may also be provided, preferably in parallel with the orifice member, in the discharge passage that leads from the discharge opening to the negative-pressure chamber.

This invention has for its object to provide an arrangement that is free from such defects.

According to major features of the invention, an arrangement is provided in which the opening for discharging the negative pressure is made in the side wall of the intake passage of the internal-combustion engine, situated downstream of a throttle valve, characterized in that the discharge opening is selected within an area of a downstream directional projection of a shaft of the throttle valve.

According to another important feature of the invention, the discharge opening is also used for controlling secondary air supply to an exhaust passage of the engine. The opening is made to be in communication with the negative-pressure chamber that has the pressure-operated member such as the earlier-mentioned diaphragm, and the control valve, connected to the member, interposed in a bypass for an air pump, the latter being provided for supplying secondary air to the exhaust passage of the engine, namely for purifying the exhaust.

Other objects, features and advantages of the invention will be better understood by reference to the description that follows, exemplified by the accompanying drawing, wherein FIG. 1 is a somewhat schematic, sectional side view of a preferred example of the inventive arrangement for deriving intake negative pressure from the carburetor of an internal-combustion engine; and FIG. 2 is a partial sectional view taken along the line II — II of FIG. 1.

Referring to the drawing, numeral 1 schematically denotes an internal-combustion engine, 2 identifies an intake passage thereof for an air-fuel mixture, and numeral 3 denotes a twin carburetor connected to the passage 2. An opening 5 is made in the carburetor 3 for discharging a negative pressure, preferably provided in the form of a a pair of right- and left-hand recesses with connecting ducts, as shown in FIG. 2 with broken lines. Outlet stumps coming from the opening 5 lead to a passage 6, shown in FIG. 1. The recesses are provided in a side wall of a lateral passage 3*a* in one side of the carburetor, downstream of a throttle valve 4 provided therein. The valve 4 has a shaft 4*a* to be explained later in more detail. Other carburetor parts are included in the drawing, such as appropriate lateral passages, needle-type and other valves, an air filter, and other well known elements of such carburetors, some of which will be described later.

The opening 5 is in communication with a negative-pressure chamber 8 through the outlet passage 6. The front surface of the chamber is constituted by a diaphragm-type member 7 that is reacts to the negative pressure in the passage 6. A check valve 9, on one side, and a preferably sintered-metal orifice member 10, on the other side, are interposed in parallel in the passage 6, which leads from the opening 5 of the carburetor 3 to the chamber 8, whereby a delay operation is effected in only one direction, negative pressure flowing from the chamber 8 to the carburetor 3.

In the illustrated exemplary arrangement secondary air is supplied to an exhaust passage 11 of the engine 1 by means of an air pump 12 for purifying the exhaust, e.g. from the intake of the carburetor 3. This air supply is controlled by the intake negative pressure of the engine. A passage 13 connects the inlet side of the carburetor 3 with a valve mechanism associated with the chamber, as shown, thereby providing secondary air by-pass from the negative-pressure unit of chamber 8 to the carburetor inlet. The air pump 12 is provided on its delivery side with a bypass passage 13*a* leading to the atmosphere, through an orifice 17, and a bypass valve 14 having a valve seat constituting a control valve that is connected to the diaphragm member 7 through a connecting rod 15 so as to open and close in response to the movement of the member 7. The latter is spring biased in a downward direction, as illustrated, while the negative pressure of the engine within the chamber 8 will tend to raise the diaphragm 7 and close the valve 14. At the bottom of the unit including these elements, a relief valve 16 may be provided.

As shown in the drawing, a check valve 18 is connected in the passage which leads from the air pump 12 to the exhaust passage 11 of the engine. A secondary air-projecting nozzle is at the end of the passage coming from the check valve 18, as shown, for a conventional introduction of additional air into the engine, in the neighborhood of the passage 2. It has been mentioned earlier that the carburetor has other conventional parts, of which some will be identified hereafter as follows: a double Venturi is shown at 31, a sub-throttle valve 32 is disposed therebelow in the carburetor 3, followed by a secondary valve 33, these elements being all conventional in such carburetors. Reverting to the top portion of the carburetor, there is a choke valve 34, followed by a Venturi 35 (which may be part of the double Venturi 31). Conventional gaskets 36*a*, 36*b*, 36*c* and 36*d* are shown between successive, vertically separated portions of the carburetor for easy assembly, cleaning and maintenance. Atop the carburetor 3, there is a conventional air cleaner 37.

According to an important detail of the invention, as shown in FIG. 1 of the drawing, there is an insert member 38 which is interposed between the main body of the carburetor, in its lower-most section, and the intake passage 2, and wherein a connecting tube 39 is integrally formed in the insert member but projects therefrom, as illustrated (just above the section line II—II). The connecting tube communicates with the discharge opening 5 of the carburetor. The somewhat crowded illustration in the right-hand portion of FIG. 1 does not readily allow the successive vertical sections of the carburetor to be identified by numerals, such as could be used 3A for the top-most part, 3B and 3C for the successive parts or portions below, and 3D, which would actually correspond to the portion which includes the insert member 38 and the connecting tube 39 therein.

The above arrangement is similar to known conventional arrangements, one of them having been proposed by the applicants themselves, but the arrangement may has the disadvantage that, as mentioned before, condensed fuel could adhere to the inner surface of the passage 3*a*, which would then flow into the passage 6 through the opening 5, to be accumulated therein, and then the fuel would flow out, and there might be a danger that the same could reach the orifice member 10 to clog the same.

As has been explained earlier in respect of the major features of the invention, a projection area A of the valve shaft 4*a* is envisaged, downstream of the shaft, and the opening 5 is made within this projection area A. This area is thus sheltered by the shaft 4*a*, and accordingly no mixture or condensed fuel is contained in the area, so that the opening 5 therein is protected against any fuel being capable of entering the same. This can be attained even if there is a pump action by the negative-pressure operated member 7.

Thus, the negative-pressure outlet or opening 5 is made in the side wall of the intake passage 3*a* so as to be situated downstream of the throttle valve 4, within the projection area A of the valve shaft, so that no fuel can enter through the opening 2. Accordingly various inconveniences that could otherwise be caused are simply and safely prevented.

According to a further feature of the invention, the opening 5 can also be used for controlling the secondary air supply to the exhaust passage 11 of the engine, so that control action is accurately effected under all conditions.

It will be understood that several additions and/or modifications can be made in the inventive arrangement so long as they are within the scope and spirit of the invention.

What we claim is:

1. An arrangement for deriving intake negative pressure from an internal-combustion engine, comprising a carburetor in the latter, with an intake for an air-fuel mixture, a throttle valve therein for regulating the mixture, and at least one longitudinal passage therein for guiding the mixture toward the engine; which latter also has an exhaust passage leading therefrom; wherein said throttle valve has a shaft substantially transversely disposed in one of said passages of the carburetor, the latter being fitted with at least one discharge opening in a side wall of said intake passage to derive negative pressure from said carburetor for regulating and controlling the engine operation; an insert member being interposed between a portion of said carburetor and said intake passage, and wherein a connecting tube is integrally formed in said insert member but projects therefrom, which tube is in communication with said dishcarge opening; the latter being provided downstream of said throttle valve in the flow of the mixture, in an area downstream from and sheltered by said valve shaft; whereby to avoid accumulation and discharge of condensed fuel from said carburetor to said discharge opening.

2. The arrangement as defined in claim 1, further comprising a control circuit for the engine, including a negative-pressure chamber connected to said at least one discharge opening, with a pressure-responsive member in said chamber; an air pump for delivering secondary air to said exhaust passage; and a control valve operable by said member, interposed in a bypass passage leading from the delivery side of said pump.

3. The arrangement as defined in claim 2, further comprising a passage leading from said at least one discharge opening to said pressure chamber, and parallel connected therein a check valve and an orifice member to obtain a delayed action for said pressure-responsive member.

4. The arrangement as defined in claim 2, further comprising a passage from said intake of the carburetor to said air pump, and another passage from the former to the side of said control valve opposite to that which said bypass passage from said delivery side of the pump is connected.

* * * * *